US010881931B2

(12) United States Patent
Reggiannini

(10) Patent No.: US 10,881,931 B2
(45) Date of Patent: Jan. 5, 2021

(54) THREE SECTION GOLF TOWEL

(71) Applicant: John A Reggiannini, Norwell, MA (US)

(72) Inventor: John A Reggiannini, Norwell, MA (US)

(73) Assignee: John A. Reggiannini, Norwell, MA (US)

( * ) Notice: Subject to any disclaimer, the term of this patent is extended or adjusted under 35 U.S.C. 154(b) by 178 days.

(21) Appl. No.: 16/202,208

(22) Filed: Nov. 28, 2018

(65) Prior Publication Data

US 2019/0176002 A1 Jun. 13, 2019

Related U.S. Application Data

(60) Provisional application No. 62/595,793, filed on Dec. 7, 2017.

(51) Int. Cl.

| | |
|---|---|
| ***A63B 57/60*** | (2015.01) |
| ***A63B 60/36*** | (2015.01) |
| ***A63B 47/04*** | (2006.01) |
| ***A63B 57/00*** | (2015.01) |
| ***A47K 10/02*** | (2006.01) |
| ***B08B 1/00*** | (2006.01) |
| ***A47L 13/16*** | (2006.01) |
| ***A63B 55/00*** | (2015.01) |

(52) U.S. Cl.

CPC ..... *A63B 57/60* (2015.10); *A63B 47/04* (2013.01); *A63B 55/408* (2015.10); *A63B 57/00* (2013.01); *A63B 60/36* (2015.10); *A47K 10/02* (2013.01); *A47L 13/16* (2013.01); *A63B 2209/00* (2013.01); *B08B 1/006* (2013.01)

(58) Field of Classification Search

CPC ..... B08B 1/006; A47L 13/10; A47L 13/16; A47K 10/02; A63B 47/04; A63B 2047/043; A63B 57/00; A63B 57/60; A63B 2057/605; A63B 60/36

USPC ..... 15/118, 208, 209.1, 210.1

See application file for complete search history.

(56) References Cited

U.S. PATENT DOCUMENTS

| | | | | |
|---|---|---|---|---|
| 5,331,705 A * | 7/1994 | Melov | A47L 13/16 | 15/118 |
| 5,761,761 A * | 6/1998 | An | A47K 10/02 | 15/114 |
| 6,351,869 B1 * | 3/2002 | Jones | A47L 13/16 | 15/209.1 |

(Continued)

FOREIGN PATENT DOCUMENTS

| | | |
|---|---|---|
| DE | 3920986 | * 1/1991 |
| JP | 2002-112918 | * 4/2002 |
| WO | 2010/140054 | * 12/2010 |

*Primary Examiner* — Mark Spisich

(74) *Attorney, Agent, or Firm* — Limin Wen

(57) ABSTRACT

A rectangular-shape three-section one-layer golf towel consists of a face section which cleans golfer's face/hands, a grip section which cleans club grips, and a club section which cleans golf club heads/golf balls. Among the three sections, the grip section is located between the face section and the club section. There are two one-inch wide connecting seams in the golf towel to separate the three sections. The three sections could have different color and could be made from different fabrics. Also, a small slit sewn in the middle of the golf towel on one edge is used to hang the golf towel on the golf bag. Such multi-functional golf towel could have different sizes.

1 Claim, 1 Drawing Sheet

(56) References Cited

U.S. PATENT DOCUMENTS

| | | | | |
|---|---|---|---|---|
| 2002/0068144 | A1* | 6/2002 | McCumber | A47K 10/02 428/82 |
| 2002/0192435 | A1* | 12/2002 | Poe, III | A47K 10/02 428/195.1 |
| 2003/0233717 | A1* | 12/2003 | Ortega | A47L 13/16 15/118 |
| 2010/0017983 | A1* | 1/2010 | Song | A63B 57/60 15/114 |
| 2011/0180102 | A1* | 7/2011 | Bradshaw | A63B 57/60 134/6 |
| 2017/0266523 | A1* | 9/2017 | Williams | A63B 57/60 |

* cited by examiner

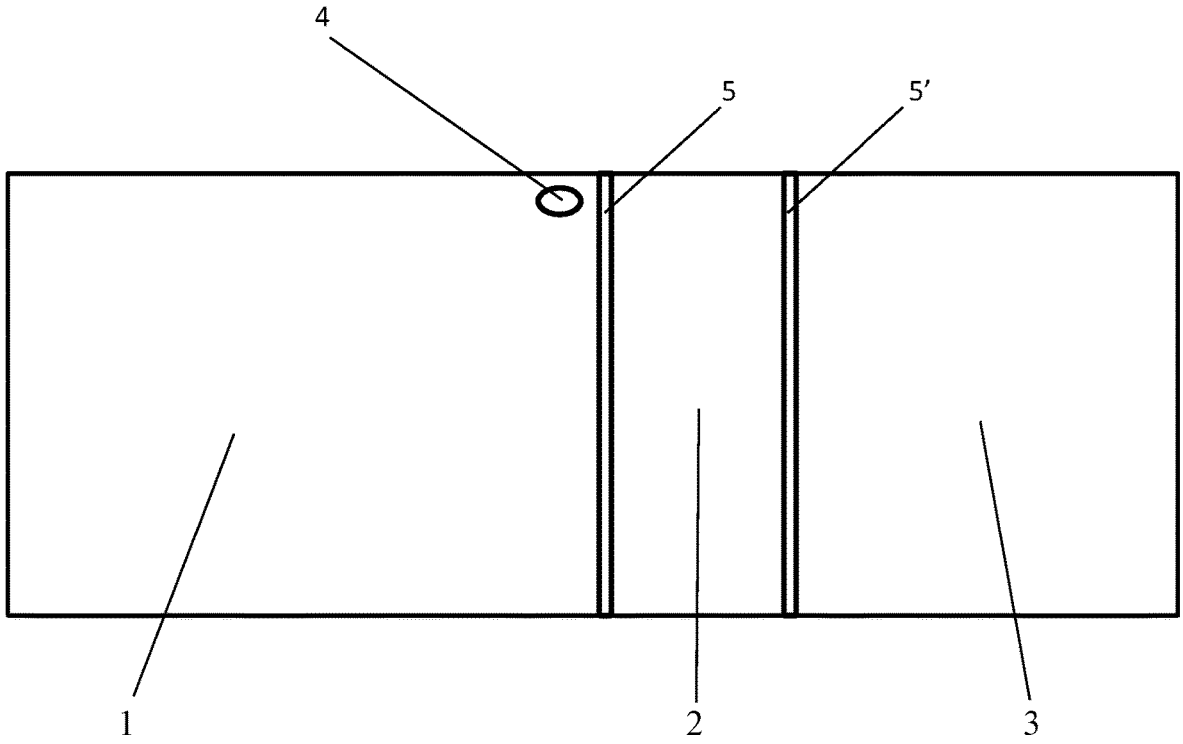
4
5
5'
1
2
3

THREE SECTION GOLF TOWEL

REFERENCE TO RELATED APPLICATION

This application claims the benefit of the filing date of U.S. Provisional Patent Application Ser. No. 62/595,793 filed on 7 Dec. 2017, entitled "A THREE-SECTION GOLF TOWEL". The teachings of the entire referenced application is incorporated herein by reference.

FIELD OF THE INVENTION

This invention relates generally to golf towels, more specifically a golf towel with three functional sections to clean golf club head, golf balls, golf club grip, and golfer's face or hand.

BACKGROUND OF THE INVENTION

It is well known that during the course of playing a round of golf, equipment such as golf clubs, golf club grip, and golf balls will get increasingly dirty or wet from use, thus affecting gameplay.

Golf clubs are precisely crafted pieces of equipment with specifically configured grooves formed in the head of the golf club. These grooves serve a specific purpose in controlling the amount of friction on the golf ball and, thus, the amount of spin that the ball exhibits.

As the object of an ideal golf swing is to strike the ball such that the club comes into close contact with the ground, doing so causes the golf club head to pick up debris such as grass and dirt that becomes embedded in the club's grooves until it is cleaned. When debris becomes engrained in these grooves during gameplay, it can substantially and undesirably affect the movement of the golf ball.

Similarly, a golf ball is specifically manufactured to have anywhere from 300 to 500 dimples, each having a diameter of approximately 4 mm, formed in the surface of the golf ball. The dimples serve a function of controlling drag and flight of the golf ball after being struck by the head of the golf club. As is typically the case, golf balls oftentimes end up in either a bunker or a muddy fairway. In doing so, the dimples of the golf ball become filled with debris from these hazards, which greatly affects the flight of the ball.

Additionally, golf club grips and golfer's hand or face are needed to be cleaned due to wet or sweat during the game. Various types of golf towels are known in the prior art. However, what is needed is a multi-functional golf towel having different sections for different cleanings. The present invented golf towel is designed to eliminate the need for multiple attachments and devices used by a golfer. So such one multi-functional golf towel enables the user quickly and easily clean and dry any and all of his/her golf equipment plus hands and faces.

The present invention provides three different sections in a golf towel to clean golf club head, golf balls, golf club grip, and golfer's face or hand.

BRIEF DESCRIPTION OF THE DRAWINGS

FIG. 1 is a top perspective view of the three-section golf towel.

DETAILED DESCRIPTION OF THE PREFERRED EMBODIMENTS

The current invention is a golf towel designed with an innovative approach to allow for the cleaning of the club, ball, grip, face and hands in three different sections. This towel has a typical rectangular shape with three sections separated by a one inch connecting seam. It is multi-colored with multiple different fabrics to allow for a specialized cleaning area for each function. Each section is labeled with small writing on the side of each section. The writing will describe the function of each section with a sleek and small font such as "C" for club head or golf ball, "G" for grip, "F" for face and hands. Both the front and the back of the section of the towel will be functional and colored the same. This towel allows cleaning club head/ball, club grip, and face/hand in three different areas. Instead of wiping the hands and face with a towel that has dirt and stains from cleaning the clubs, the hands and face have a designated area that will never be visibly dirty even after washing the towel. It is the first towel that is color coded with each section's color representing each function. Because the dirt is hidden in the colored area, the towel always has a look of a clean and elegant design.

As shown in FIG. 1, the first section of the towel is used to clean the hands and face, called face section (1). This is the largest section of the towel ranging from 8 to 30 inches long and 16 to 20 inches wide depending on the size of the towel. This section prefers to be white to provide a clean look that will appeal to players when wiping their faces and hands. The preferred fabric for this section is 100 percent cotton in a white color because it is the most absorbent but soft material for the face and it is easy to clean and remove any stains. However, every section of the towel is customizable. The towel is designed from a variety of colors or fabrics for each section. Every section of the towel can be the same or different in term of color or fabric materials. For example, the towel could have three different colors for each section, or the same color for two sections and different color for the third section.

As shown in FIG. 1, the second section is the smallest section of the towel, called grip section (2). It is meant to clean the sweat and dirt off of the grips of the clubs. This section will range from 5 to 8 inches long and 16 to 20 inches wide depending on the size of the towel. In the standard invented towel, this section is made of cotton fabric in a dark gray color. This section can also be any color or material.

As shown in FIG. 1, the third section of the towel is used to clean the dirt off of the face of the club head or the golf ball, called club section (3). This section is the second largest section of the towel ranging from 8 to 15 inches long and 16 to 20 inches wide depending on the size of the towel. This section can be customized in terms of fabric. The recommended fabrics are cotton and waffled weave microfiber, but it can be customized to fit the player's needs. The recommended color for this section of the standard invented towel is black. This ensures that the dirt from the club or ball is almost always hidden by the dark color and there is no appearance of a dirty towel.

In the middle of the invented towel on one edge, there is a small 1-inch slit (4) sewn in shown in FIG. 1. This hole in the towel will enable a player to hang the towel on the golf bag. The towel can be hung with a clip that is sometimes provided on the golf bag, or it can fit around an item in the bag such as an alignment stick.

As shown in FIG. 1, the design of the towel is simple and sleek with the three rectangular sections connected by a 1-inch piece of fabric called connecting seam (5, 5') and edged with thread that can also be customized in terms of color. It is recommended that the separation pieces, e.g. the connecting seam (5, 5'), in between each section is a darker color to hide any dirt that it may pick up but it can be changed to any basic color. The invented towel also allows for a company, organization, golf course, or team to advertise its name and logo on it. A sponsor can add the logo on any part of the towel. There could be a logo on every towel on the bottom of the dark section that is used for club cleaning. The design is very sleek and attractive to the eye and could be available in many colors and fabrics.

The towel can be any size, but the three standard sizes are small, medium, and large. The small size is in total 16 inches wide by 28 inches long with the club section being 11 inches long, the grip section being 5 inches long, and the face section being 10 inches long. The medium size towel is in total 16 inches wide by 36 inches long with the club section reaching 11 inches long, the grip section being 5 inches long, and the face section being 18 inches long. The large size towel is in total 20 inches wide by 44 inches long with the club section being 12 inches long, the grip section being 6 inches long, and the face section being 24 inches long.

In summary, the present invention provides novel golf towel with three functional sections to clean golf club head/golf ball, club grip, and golfer's face and hands. These three sections could be made in different sizes with different materials and/or colors. Such multi-functional golf towel is a simple one piece towel with different sections, which is very convenient to golfers to clean their equipment and their face or hands.

Although this three-section golf towel and the method of using the same according to the present invention have been described in the foregoing specification with considerable details, it is to be understood that modifications may be made to the invention which do not exceed the scope of the claims and modified forms of the present invention done by others skilled in the art to which the invention pertains will be considered infringements of this invention when those modified forms fall within the claimed scope of this invention.

What is claimed is:

1. A single one-layer golf towel with three functional sections comprising a towel, wherein said golf towel has two sides; wherein said towel has a rectangular shape; wherein said golf towel is divided into three sections consisting of a face section, a grip section, and a club section; wherein said face section is to clean golfer's face and hands; wherein said grip section is to clean club grips; wherein said club section is to clean golf club heads and golf balls; wherein said grip section is between said face section and said club section; wherein said three sections are separated by two one-inch wide connecting seams between said face section and said grip section and between said grip section and said club section; wherein said three sections have different colors and have different fabrics for each specialized cleaning function; wherein both sides of each said section of said towel have the same color and fabric for the same cleaning function; wherein said three sections are interchangeable in terms of locations, colors and fabrics; wherein said golf towel has a small slit sewn in the middle of said golf towel on one edge; wherein said face section is the largest section of said golf towel ranging from 8 to 30 inches long and 16 to 20 inches wide depending on the size of said golf towel, wherein said face section is made from 100 percent cotton in a first color; wherein said grip section is the smallest section of said golf towel ranging from 5 to 8 inches long and 16 to 20 inches wide depending on the size of said golf towel, wherein said grip section is made from customized fabric in a second color different than the first color; wherein said club section is the second largest section of said golf towel ranging from 8 to 15 inches long and 16 to 20 inches wide depending on the size of said golf towel, wherein said club section is made from customized fabric in a third color different than at least one of the first and second colors.

* * * * *